US007435132B1

(12) United States Patent
Fong et al.

(10) Patent No.: US 7,435,132 B1
(45) Date of Patent: Oct. 14, 2008

(54) CABLE CONNECTOR ASSEMBLY WITH IMPROVED GROUNDING MEMBER

(75) Inventors: Jen-Guo Fong, Tu-Cheng (TW); Eric (Yun-chien) Lin, Fullerton, CA (US); Pei Tsao, Fullerton, CA (US); Joseph Tang, Fullerton, CA (US); An-Jen Yang, Fullerton, CA (US); Tien-Lu Kao, Fullerton, CA (US); Yin-Tse Kao, Fullerton, CA (US); Lisa Chou, Fullerton, CA (US); Jim Zhao, Fullerton, CA (US); Wei Yao, Kun-Shan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/001,688

(22) Filed: Dec. 12, 2007

(51) Int. Cl.
*H01R 12/24* (2006.01)

(52) U.S. Cl. ..... 439/497

(58) Field of Classification Search ..... 439/497, 439/493, 579
See application file for complete search history.

(56) References Cited

U.S. PATENT DOCUMENTS 5,085,596 A * 2/1992 Bowen et al. ..... 439/497
6,482,028 B2 * 11/2002 Kumamoto et al. ..... 439/498
6,685,501 B1 * 2/2004 Wu et al. ..... 439/497
6,726,503 B2 4/2004 Waddell et al.
6,739,904 B2 5/2004 Wu
6,764,342 B2 * 7/2004 Murayama et al. ..... 439/608
6,869,308 B2 3/2005 Wu
7,357,673 B2 * 4/2008 Long ..... 439/608

* cited by examiner

*Primary Examiner*—Phuong K Dinh
(74) *Attorney, Agent, or Firm*—Wei Te Chung

(57) ABSTRACT

A cable connector assembly (100) includes a printed circuit board (2) having a number of signal and ground pads (25, 26) alternatively arranged at opposite front and rear ends thereof, a wire organizer (3) defining a number of through holes (30), a unitary grounding member (6) assembled to the wire organizer and including a number of grounding plates (62) integrally formed therewith to electrically connect with the ground pads of the printed circuit board, and a number of wires (4) protruding through the through holes of the wire organizer. Each wire includes at least one signal conductor (40) soldered with the signal pad of the printed circuit board, an insulator (41) enclosing the at least one signal conductor and a ground conductor (43) electrically connecting with the grounding member to form ground path with the printed circuit board.

3 Claims, 4 Drawing Sheets

CABLE CONNECTOR ASSEMBLY WITH IMPROVED GROUNDING MEMBER

BACKGROUND OF THE INVENTION

1. Field of the Invention

The present invention generally relates to a cable connector assembly, and more particularly to a cable connector assembly for high-speed signal transmission.

2. Description of Related Art

For high-speed signal transmission electrical connectors, EMI and wire management are two most significant problems to be solved since such electrical connector usually has a large number of wires to transmit signals which need to be managed. Infiniband connector is a kind of high-speed signal transmission connector which comprises an insulative housing, a plurality of signal and ground terminals retained in the insulative housing, a spacer assembled to the housing and the terminals, a plurality of wires each comprising a signal differential pair transmitting positive and negative signals and a grounding conductor. The wires are managed by the spacer with the signal differential pairs and the grounding conductors respectively electrically connecting with the signal and ground terminals. Additionally, for depressing EMI, a grounding member is adopted to electrically connect with the ground terminals and the grounding conductors.

Such features are disclosed in U.S. Pat. Nos. 6,685,501, 6,726,503, 6,764,342, 6,869,308, and 6,739,904. As for U.S. Pat. Nos. 6,685,501, 6,869,308 and 6,739,904, each spacer disclosed therein is a whole piece or a pair of upper and lower halves defines a plurality of aligning holes to permit the penetration of wires for aligning the wires. Each spacer is assembled with a large number of grounding plates each soldered to corresponding grounding conductors of the wires and ground terminal to depress EMI in signal transmission. However, the number of the grounding plates is large which is costly and assembling the so many grounding plates to the spacer is time consuming and also costly.

U.S. Pat. No. 6,726,503 discloses an Infiniband type connector with a spacer having upper and lower halves assembled together to align wires and engaging with tail portions of ground terminals with grounding conductors electrically connecting with the tail portions of the ground terminals. U.S. Pat. No. 6,764,342 discloses a whole-piece spacer aligning wires and assembled with a pair of grounding plates and short arms of ground terminals with the grounding plates directly electrically connecting with grounding conductors of the wires and the short arms of the ground terminals to form electrical connection between the ground terminals and the grounding conductors of the wires. However, the ground terminals of these two connectors all directly connect the grounding plates or the grounding conductors of the wires. In some circumstances, a printed circuit board is needed to realize the electrical connection between terminals and wires. The spacers and the grounding plates are not suitable for above circumstance. Therefore, a cable connector with improved wire organizer and grounding plate is desired to be developed to address above problems.

BRIEF SUMMARY OF THE INVENTION

Accordingly, an object of the present invention is to provide a cable connector assembly with improved grounding member to achieve EMI depression and low cost.

In order to achieve the above-mentioned object, a cable connector assembly in accordance with the present invention comprises a printed circuit board having a plurality of signal and ground pads alternatively arranged at opposite front and rear ends thereof, a wire organizer defining a plurality of through holes, a unitary grounding member assembled to the wire organizer and comprising a plurality of grounding plates integrally formed therewith to electrically connect with the ground pads of the printed circuit board, and a plurality of wires protruding through the through holes of the wire organizer. Each wire comprises at least one signal conductor soldered with the signal pad of the printed circuit board, an insulator enclosing the at least one signal conductor and a ground conductor electrically connecting with the grounding member to form ground path with the printed circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
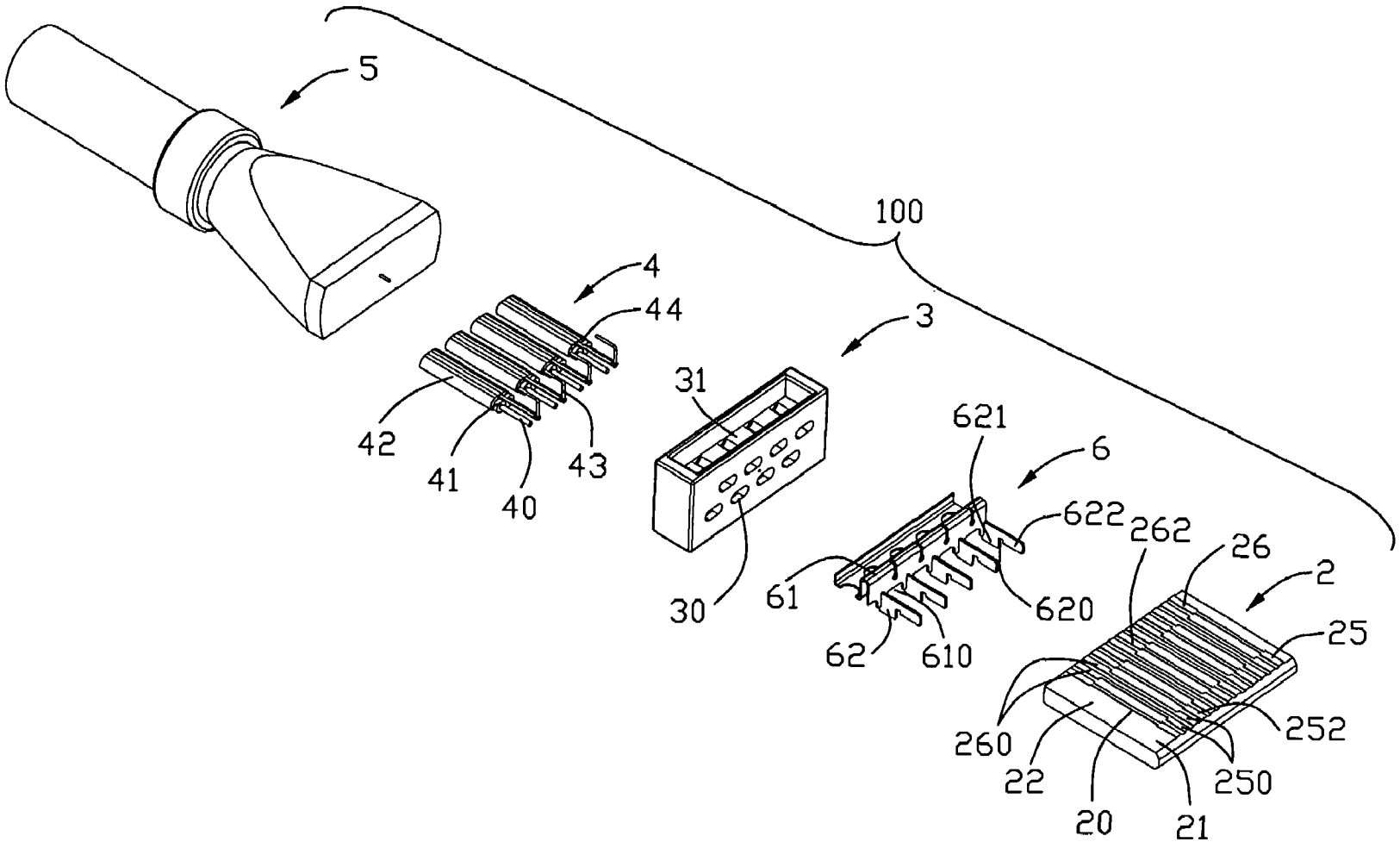
FIG. 1 is an exploded, perspective view of a cable connector assembly in accordance with the preferred embodiment of the present invention.

Reference will now be made to the drawing figures to describe the present invention in detail.

Figure 2:
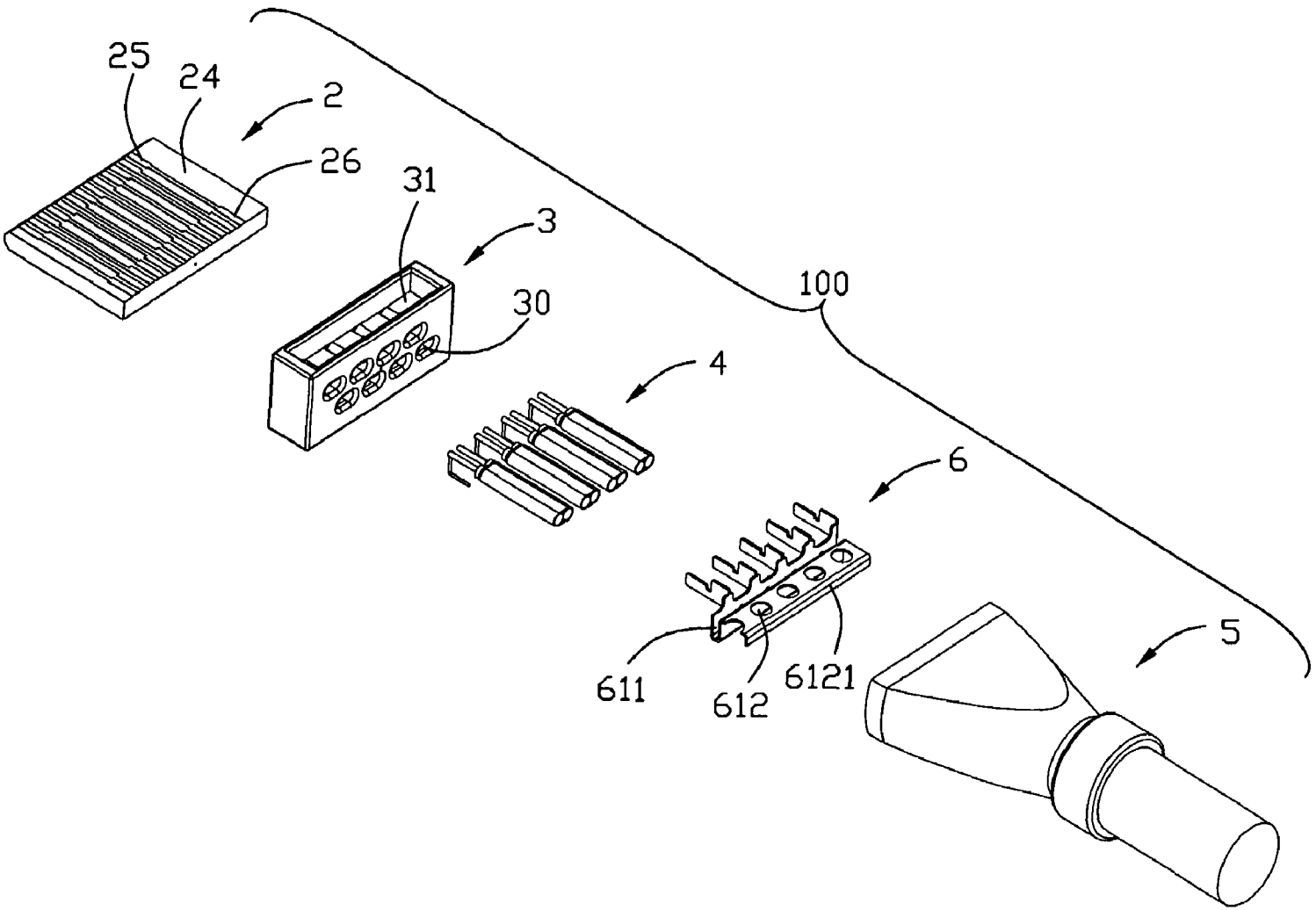
FIG. 2 is a view similar to FIG. 1, but viewed from a different aspect.
Figure 3:
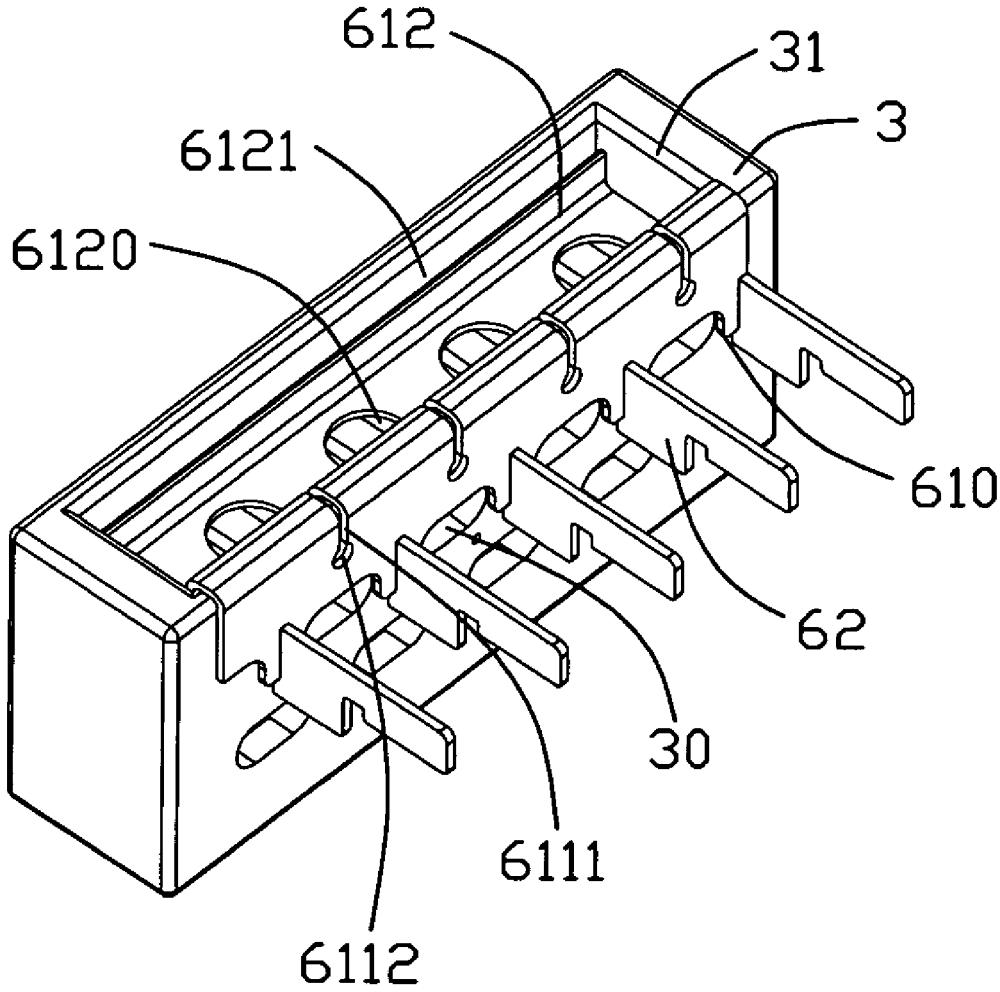
FIG. 3 is a partially assembled view of FIG. 1.
Figure 4:
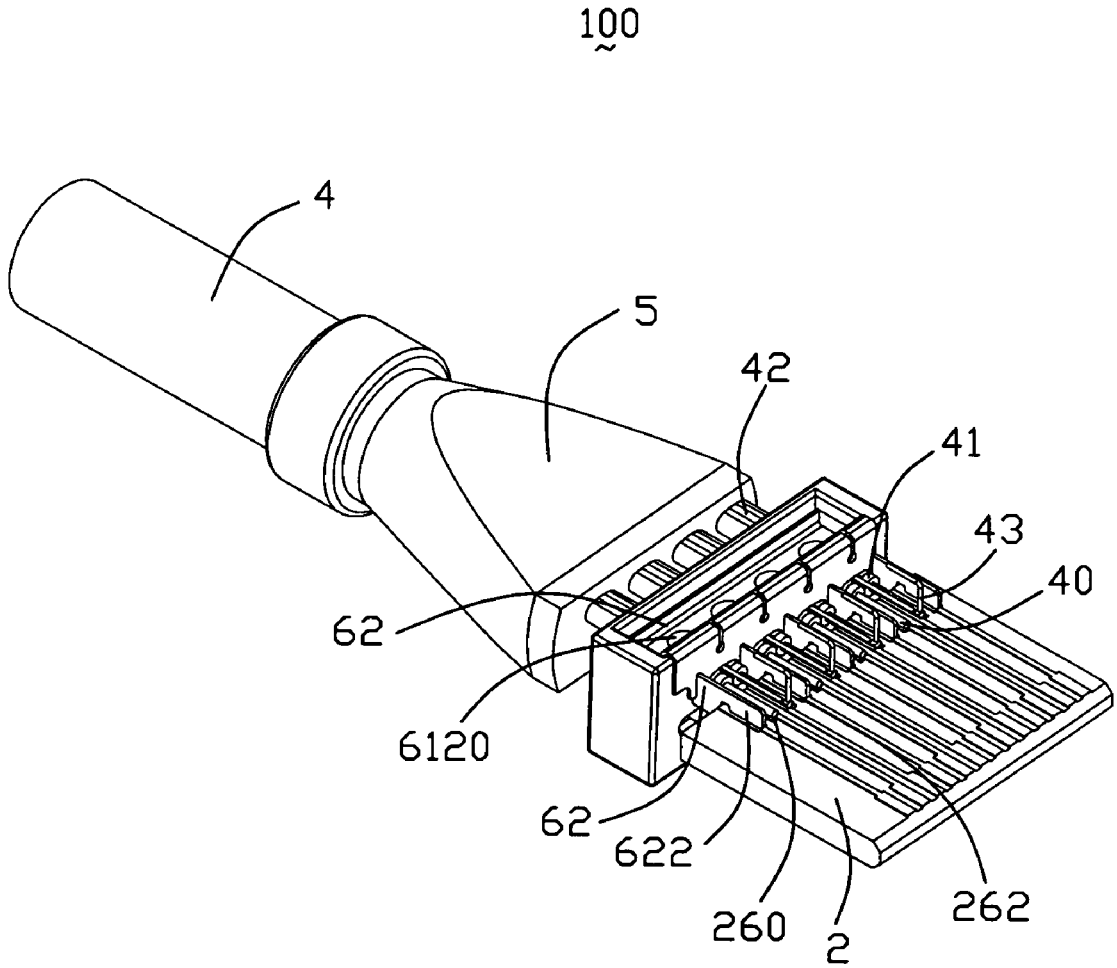
FIG. 4 is an assembled, perspective view of FIG. 1.

Please refer to FIGS. 1-2, a cable connector assembly 100 in accordance with the preferred embodiment of the present invention comprises a printed circuit board (PCB) 2, a pair of metal grounding members 6 (only one is shown) electrically connecting with the PCB 2 and wires 4, a wire organizer 3 aligning the wires 4 and engagingly receiving the grounding members 6, the wires 4 electrically connecting with the grounding members 6 and the PCB 2 at the same time, an inner mold 5 molded with the wires 4, and a die-cast casing (not shown) enclosing all the members mentioned above therein with the wires 4 exiting from rear end of the casing and the mating interface accessible from front end of the casing.

The PCB 2 is a flat board, and comprises opposite front and rear ends 21, 22 and opposite upper and lower surfaces 23, 24. A plurality of first and second conductive pads 25, 26 are formed at front and rear ends 21, 22 of the upper and lower surfaces 23, 24. The first and second conductive pads 25, 26 are in pairs along front-to-rear direction and each pair 25, 26 connects to each other by a conductive trace 20. Each set of the first and second conductive pads 25, 26 consist of four sets of signal differential pairs 250, 260 and five ground pads 252, 262 alternatively arranged with the signal differential pairs 250, 260 for assuring signal transmission effect.

The wire organizer 3 made from insulative material is of a rectangular block. The wire organizer 3 defines upper and lower rows of elliptic-shape through holes 30 spaced arranged along transverse direction. The inner periphery of each through hole 30 is same as outer periphery of each wire 4. The through holes 30 of the upper row are not aligned with the through holes 30 of the lower row in up-to-down direction. That is, each through hole 30 of the upper row is substantially located between a pair of through holes 30 of the lower row. A pair of openings 31 are respectively recessed downwardly and upwardly from upper and lower surfaces of the body portion 30 and respectively communicate with the through holes 300 of the upper row and the through holes 30 of the lower row.

Each grounding member 6 comprises a fitting portion 61 interferentially received in the openings 31 of the wire organizer 3, and a plurality of grounding plates 62 extending forwardly from lower/top edge of the fitting portion 61. The lower/top edge of each fitting portion 61 defines a plurality of semi-elliptical receiving spaces 610 between adjacent two grounding plates 62 for receiving the wires 4. Each grounding plate 62 is located in a vertical plane and substantially of L-shape. The grounding plate 62 comprises a rear wider stop section 621 connecting with the fitting portion 61 and a narrower soldering section 622 extending from upper/lower part of the stop section 621 of upper/lower row. A slit 620 extends upwardly/downwardly from the joint location of the stop section 621 and the soldering section 622 for receiving excessive solder when soldering the grounding members 6 with the ground pads 262 of the PCB 2. The structure of the fitting portion 61 of the grounding member 6 is corresponding to outer periphery of the opening 31. The fitting portion 61 comprises a U-shape sandwiching section 611 sandwiching a vertical front edge of the opening 31 and a flat pressing section 612 extending rearwardly from rear edge of the sandwiching section 611 to press on the wires 4 received in the through holes 30. A vertical flange 6121 extends upwardly a certain distance from rear edge of the pressing section 612 for preventing warp of the pressing section 612 from the opening 31. A plurality of slits 6111 are defined in the sandwiching section 611.

The wires 4 are divided into upper and lower groups (only one row is shown) corresponding to the through holes 30 of the wire organizer 3, that is, each wire 4 of the upper group is located in the middle of the two adjacent wires 4 of the lower group viewed from up-to-down direction. Such arrangement helps to reduce cross talk in signal transmission. Each wire 4 comprises a pair of signal conductors 40 respectively transmitting positive and negative signals, a pair of insulators 41 respectively enclosing corresponding signal conductors 40, a pair of conductive layers 44 surrounding the insulators 41, a ground conductor 43 disposed between the pair of signal conductors 40 and electrically contacting the conductive layers 44, and an outer jacket 42 enclosing the conductor layers 44 and the ground conductor 43 therein. The front end of the wire 4 is partially stripped to expose the pair of signal conductors 40, the front ends of the pair of insulators 41, the pair of conductive layers 44 and the ground conductor 43 along front-to-back direction. The ground conductor 43 exposed out of the outer jacket 42 is longer than the signal conductors 40 exposed out of the outer jacket 42 for being of U-shape to locate above/below the pair of signal conductors 40 after assembling to the wire organizer 3.

When assembly, the inner mold 5 is firstly molded with the wires 4 to hold the wires 4 together. Then, the wires 4 respectively protrude through the through holes 30 of the wire organizer 3 to fill up the through holes 30 with upper and lower parts of the outer jackets 42 thereof exposed in the openings 30. Then the grounding member 6 is assembled to the wire organizer 3 and the wires 4 with the fitting portion 61 interferentially received in the opening 30 as described above and each grounding plate 62 locating between two adjacent wires 4. The pressing section 612 is pushed to exert a downward/upward force to the wires 4 to press the exposed portions of the wires 4 for adjusting the configurations of the wires 4 to fit in the through holes 30 well. There are four round positioning holes 6120 in the pressing section 612 corresponding to the position of the wires 4. Glue or other may spread to the positioning holes 6120 to position the wires to the grounding member 6. Further, Glue made from Epoxy Bong may be spread to the openings 31 of the wire organizer 3 to retain the wire organizer 3 with the grounding plate 6. After such assembly, the front ends of the signal conductors 40 substantially flush with the front edges of the grounding plates 62. Then, the wires 4 and the grounding member 6 are assembled to the PCB 2 together with the stop portions 621 abutting against the rear end 22 of the PCB 2. The soldering portions 622 of the grounding plates 62 and the signal conductors 40 are respectively soldered to the ground pads 262 and the signal differential pairs 260 of the second conductive pads 26 to form electrical connection therebetween. The ground conductors 43 are formed into U-shape and soldered to side surfaces of the grounding plates 62. Thus, signal transmission paths and grounding paths are established. In alternative embodiment, the ground conductors 43 also can be pressed through the slits 6111 into conductor-receiving slots 6112 to electrically connect with the grounding member 6 to form ground paths with the PCB 2. When mating with a complementary connector, the first conductive pads 25 of the PCB 2 may directly electrically connect with terminals of the complementary connector, or soldered with contacts (not shown) assembled into an insulative housing (not shown) of the cable connector assembly of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for high-speed signal transmission, comprising:

a printed circuit board having a plurality of signal and ground pads alternatively arranged at opposite front and rear ends thereof;

a wire organizer defining a plurality of through holes;

a unitary grounding member assembled to the wire organizer and comprising a plurality of grounding plates integrally formed therewith to electrically connect with the ground pads of the printed circuit board;

a plurality of wires protruding through the through holes of the wire organizer, each wire comprising at least one signal conductor soldered with the signal pad of the printed circuit board, an insulator enclosing the at least one signal conductor and a ground conductor electrically connecting with the grounding member to form ground path with the printed circuit board, wherein the at least one signal conductor of each wire locates between adjacent two grounding plates of the wire organizer, wherein the grounding member comprises a fitting portion interferentially engaging with the wire organizer and the plurality of grounding plates extending forwardly beyond the wire organizer and alternatively arranged with the wires, wherein the wire organizer defines an opening recessed therein to communicate with the through holes with the wires partially exposed in the opening, and wherein the fitting portion is received in the opening to press on the exposed wires, wherein fitting portion comprises a pressing section pressing on the exposed wires and an-shape sandwiching section sandwiching an edge of the opening, and wherein the grounding plates extend forwardly from the sandwiching section, wherein the fitting portion defines a plurality of positioning holes to partially expose the wires, and wherein glue is spread into the positioning holes to position the wires with the grounding member, wherein the sandwiching section of the fitting portion defines a plurality of conductor-receiving slots therein, and wherein the ground conductors of the wires are at least respectively soldered to grounding plates of the grounding member or received in the conductor-receiving slots, wherein each wire comprises a pair of signal conductors respectively transmitting positive and negative signals, and wherein the signal pads of the printed circuit board form a plurality of signal differential pairs alternatively arranged with the ground pads to electrically connect with the signal conductors.

2. The cable connector assembly as claimed in claim 1, wherein each grounding plate locates in a vertical plane and is of L-shape, the grounding plate comprises a stop portion and abutting against rear end of the printed circuit board and a soldering portion extending forwardly from the stop portion to be soldered with the ground pad of the printed circuit board.

3. A cable connector assembly adapted for high-speed transmission, comprising:

a plurality of signal contacts consisting signal differential pairs transmitting positive and negative signals;

a plurality of ground contacts alternatively arranged with the signal differential pairs;

a wire organizer defining a plurality of through holes;

a plurality of wires, each wire comprising a pair of signal conductors and a ground conductor isolating from the signal conductors; and a unitary grounding member assembled to the wire organizer and comprising a plurality of grounding plates alternatively arranged with the wires to electrically connect the ground conductors of the wires; and wherein the wires protrude through corresponding through holes of the wire organizer with front ends of the signal and ground conductors exposed beyond front surface of the wire organizer to each locate between adjacent two grounding plates, and the exposed signal conductors and the grounding plates respectively soldered with the signal differential pairs and the grounding contacts, wherein the ground conductor of each wire is soldered to the ground plate of the grounding member, wherein the grounding member comprises a fitting portion interferentially engaging with the wire organizer and defining a plurality of conductor-receiving slots above the through holes of the wire organizer, and wherein the ground conductors of the wires are received in the conductor-receiving slots to form electrical connection with the grounding member, wherein each grounding plate of the grounding member is located in a vertical plane with a certain width along up-to-down direction to shield corresponding signal differential pair of the wire.

* * * * *